United States Patent [19]

Croasdale

[11] 4,114,725

[45] Sep. 19, 1978

[54] SHIELD AND ACOUSTICAL ASSEMBLY

[75] Inventor: William H. Croasdale, Morris Plains, N.J.

[73] Assignee: American Can Company, Greenwich, Conn.

[21] Appl. No.: 734,665

[22] Filed: Oct. 21, 1976

[51] Int. Cl.[2] ..... E04H 17/00; G10K 11/00

[52] U.S. Cl. ..... 181/205; 181/210; 181/286; 181/293; 181/295

[58] Field of Search ..... 181/210, 224, 205, 284, 181/285, 286, 290, 291, 292; 256/13.1; 52/145, 618, 625

[56] References Cited

U.S. PATENT DOCUMENTS 3,656,576 4/1972 Gubela ..... 181/210

*Primary Examiner*—L. T. Hix
*Assistant Examiner*—Benjamin R. Fuller
*Attorney, Agent, or Firm*—Robert P. Auber; George P. Ziehmer; Ira S. Dorman

[57] ABSTRACT

A shield for an assembly includes a member of generally corrugated construction, which is uniquely configured to substantially prevent the passage of liquid contaminants impinging thereon. The invention is especially concerned with the provision of an acoustical assembly employing such a shield.

16 Claims, 2 Drawing Figures

SHIELD AND ACOUSTICAL ASSEMBLY

BACKGROUND OF THE INVENTION

Assemblies used for noise abatement and, in particular, those employed to minimize excessive noise emanating from plant or factory machinery, are well known in the art. Typically, they consist of an enclosure surrounding the noise-generating equipment, the enclosure being constructed of panels including an outer wall having low sound transmission properties, an inner perforated wall, and an acoustically absorbent material disposed between the inner and outer walls.

To protect the acoustical material from liquid contaminants (e.g., lubricants, coolants, solvents, etc.) which are often thrown by such equipment, the material is usually coated or wrapped with a thin layer of a moisture-proof plastic. However, since the protective coatings and films tend to tear or puncture quite readily, the level of protection afforded is often inadequate. While contamination does not normally inhibit the sound absorption properties of the assembly to an appreciable extent, it does present a significant fire and safety hazard, as well as other concerns. As far as is known, no presently-available assembly has effectively dealt with these problems.

Accordingly, it is an object of this invention to provide a novel shield which serves as a highly effective barrier against splashing liquid contaminants.

It is also an object of this invention to provide such a shield, which is of relatively simple, inexpensive and durable construction, and is convenient to install.

Another and more specific object of the invention is to provide a novel, noise-abating acoustical assembly, in which safety hazards and other problems are minimized.

SUMMARY OF THE INVENTION

It has now been found that certain of the foregoing and related objects are readily attained in a shield for an assembly, which includes a member of generally corrugated construction adapted for mounting in a planar disposition. Each corrugation of the member consists of a forward element and a rearward element, the forward element being substantially imperforate and the rearward element having perforations formed therein. The rearward element is disposed effectively behind the forward element, and is screened thereby from contact by matter impinging upon the shield in a direction generally normal to the mounting plane.

Preferably, the perforations of the rearward element of each of the corrugations cooperatively define a combined open area which constitutes about one-third of the surface area of the rearward element. Generally, the inner margin of the rearward element of each corrugation will be directly joined to the inner margin of the forward element of the subjacent corrugation, and the shield will advantageously include an imperforate frame extending about the periphery of the corrugated member and enclosing the sides and ends thereof. Typically, the shield will be fabricated from metal. In the particularly preferred emodiments, the forward element and the rearward element of each of the corrugations are both generally planar and are obliquely disposed relative to the mounting plane, with the rearward element being disposed at an obtuse included angle (most desirably of about 95 degrees) relative thereto.

Certain objects of the invention are attained in an acoustical assembly which employs the shield of the foregoing description, and which further includes a sound-absorbing material secured against the rearward side of the shield. In such an assembly, the shield desirably includes an imperforate frame extending about the periphery of both the corrugated member and also the acoustical material, enclosing the sides and ends of both elements. The assembly may also employ an imperforate backing member secured to the frame of the shield, with the absorbent material disposed therebetween, and a moisture-proof material covering the acoustical material may additionally be provided. Generally, such a backing member will be fabricated from metal, and the moisture-proof material will be plastic.

DETAILED DESCRIPTION OF THE ILLUSTRATED EMBODIMENT

Figure 1:
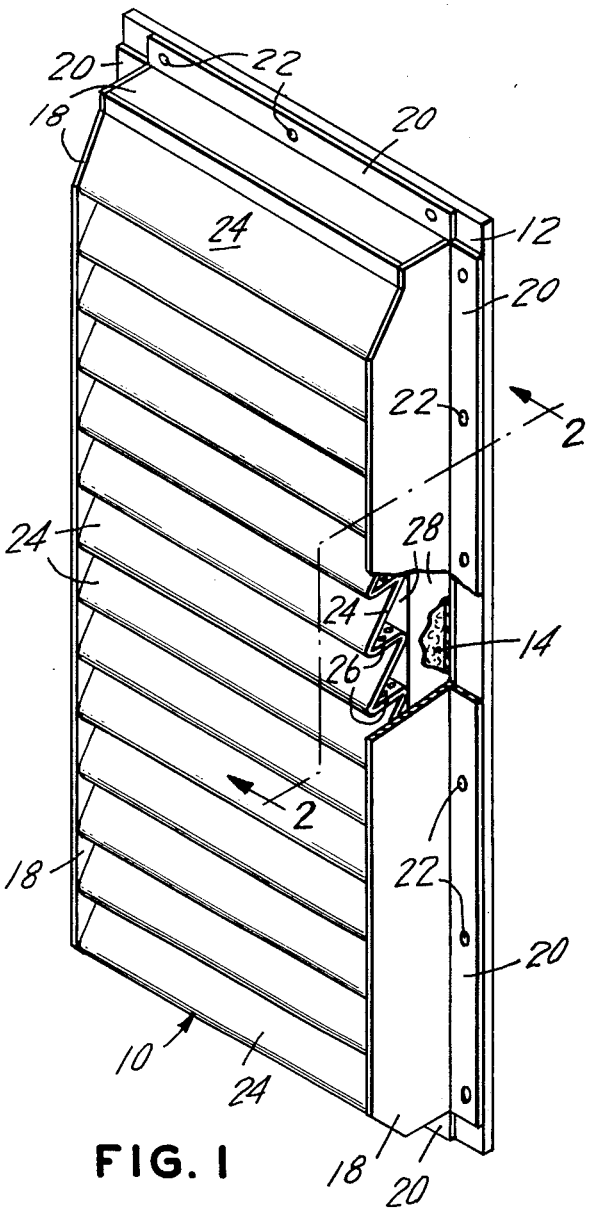
FIG. 1 is a perspective view of a novel acoustical assembly embodying the present invention with a portion of the shield frame and moisture impermeable material broken away to show interior construction.

Turning now in detail to the appended drawing, therein illustrated is an acoustical assembly embodying the present invention, and including a rectangular, corrugated shield, generally designated by the numeral 10, a corresponding imperforate backing member 12, and a pad or mat 14 of sound-absorbing, acoustical material interposed therebetween. An imperforate frame 18 extends about the periphery of the shield 10, enclosing the sides and ends thereof, and is of sufficient width to also enclose the sides and ends of the acoustical material 14; it has four flanges 20 extending outwardly from the rearward edges thereof, which serve to mount the backing member 12, secured thereto by suitable fasteners 22.

Figure 2:
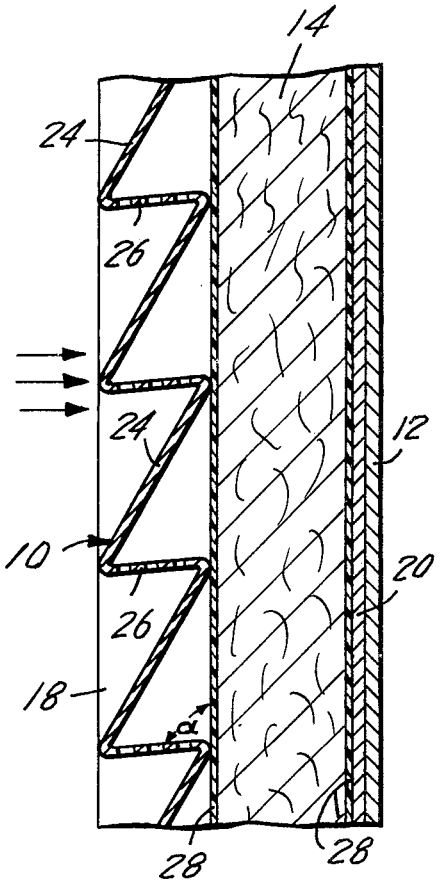
FIG. 2 is an enlarged, fragmentary cross-sectional view along line 2—2 of FIG. 1, with additional portions of the shield frame and moisture-impermeable material being broken away.

As is shown more clearly in FIG. 2, each corrugation of the shield 10 consists of a substantially imperforate, generally planar forward element 24, and a perforated, generally planar rearward element 26, the latter permitting the passage of sound and being disposed effectively behind the former. Thus, the forward element 24 shields the rearward element 26 from contact with matter impinging on the shield 10, especially in a direction (as shown by the arrows) generally normal to the mounting plane of the assembly (coinciding with the plane of the backing member 12), thereby minimizing the passage of such matter into the interior of the assembly, and the resultant disadvantages that would occur. More particularly, each of the elements 24, 26 is obliquely oriented relative to the mounting plane, with the rearward element 26 being disposed at an obtuse included angle (i.e., angle "a") relative thereto, which angle is preferably about ninety-five degrees. It should be appreciated that, while a perpendicular orientation of the rearward element 26 (i.e., an included angle "a" of ninety degrees) may provide adequate splash protection, the obtuse angular disposition is preferred in that it will promote the outward flow of liquids, thereby further reducing the likelihood that the acoustical mat 14 will become contaminated therewith.

The rearward element 26 should be sufficiently perforated to permit passage of substantially all of the sound generated, with a minimum amount of reflection. Generally, if the perforations cooperatively define a combined open area which constitutes about one-third of the total surface area of the rearward element 26, it will effectively be "transparent" to sound. On the other hand, both the shield 10 and also the imperforate backing member 12 should be fabricated from a material having low sound transmission properties, to effectively trap the noise passing through the perforated rearward elements 26 within the interior of the assembly. Thus, the cooperative effects of sound reflection between the shield 10 and the backing member 12, and of absorption by the acoustical material, very effectively produce the attenuation which is desired.

To provide a further measure of protection for the acoustical material mat 14, it may be wrapped or coated with a thin layer of a moisture-impermeable material 28, it being appreciated that the shield provides physical protection to the covering material 28, minimizing the previously mentioned tendency for tearing and puncturing to occur therein.

The materials from which the components of the assembly are fabricated are well known, and will be apparent to those skilled in the art. Typically, the structural parts will be made of steel (stainless, for some applications), the acoustical material will be of glass fibers (e.g., Owens Corning FIBERGLAS), and the plastic overwrap will be a polyester (e.g., DuPont MYLAR), it being appreciated that the foregoing is merely exemplary of the many possible materials that can be used, and not limiting upon the scope of the invention.

While the instant shield and acoustical assembly have been described in relation to the illustrated and preferred embodiment, modifications may be made as will be apparent to those skilled in the art. For instance, the configuration, size and spacing of the corrugations and the perforations in the rearward elements will be adapted to suit the particular environment involved, and/or the particular angular disposition of the assembly. Moreover, while the instant illustrated embodiment is particularly suited for modular construction, so as to permit adaption to a variety of machine set-ups, the assembly itself may be used for surfacing of walls or ceilings; in such a case, the existing supporting structure may serve in lieu of the backing member hereinbefore described.

Thus, it can be seen that the present invention provides a novel shield which serves as a highly effective barrier against splashings liquid contaminants. The shield may be employed in a novel noise abatement acoustical assembly to minimize safety hazards and other problems; it is of relatively simple, inexpensive and durable construction, and is convenient to install.

What is claimed is:

1. A shield for an assembly, comprised of a member of generally corrugated construction adapted for mounting in a generally vertical position, each corrugation of said member consisting of a forward element and a rearward element joined at a common forward edge, adjacent corrugations of said member being joined at common rearward edges, with said common rearward edges of said corrugations being disposed on a common plane, said forward elements being substantially imperforate, and said rearward elements thereof having perforations formed therein to permit sound waves to pass there-through to the rearward side of said shield, said rearward element of each corrugation forming an obtuse included angle with said common plane, to dispose said rearward element of said corrugation therebehind, thereby screening said rearward element from contact by matter impinging upon said shield in a direction generally normal to said plane, and preventing liquid, descending over said shield, in the normal generally vertical position thereof, from entering said perforations.

2. The shield of claim 1 wherein said perforations of said rearward element of each of said corrugations cooperatively define a combined open area which constitutes about one-third of the surface area of said rearward element.

3. The shield of claim 1 further including an imperforate frame extending about the periphery of said corrugated member and enclosing the sides and ends thereof.

4. The shield of claim 1 wherein said shield is fabricated from metal.

5. The shield of claim 1 wherein said forward element and said rearward element of each of said corrugations are both generally planar.

6. The shield of claim 1 wherein said included obtuse angle is about 95°.

7. An acoustical assembly comprising: a shield comprised of a member of generally corrugated construction adapted for mounting in a generally vertical position, each corcugation of said member consisting of a forward element and a rearward element joined at a common forward edge, adjacent corrugations of said member being joined at common rearward edges, with said common rearward edges of said corrugations being disposed on a common plane, said forward elements being substantially imperforate, and said rearward elements having perforations formed therein to permit sound waves to pass there-through to the rearward side of said shield, said rearward element of each corrugation forming an obtuse included angle with said common plane, to dispose said rearward element of said corrugation therebehind, thereby screening said rearward element from contact by matter impinging upon said shield in a direction generally normal to said plane, and preventing liquid, descending over said shield in the normal, generally vertical position thereof, from entering said perforations; and a sound absorbing material secured against said rearward side of said shield.

8. The assembly of claim 7 wherein said perforations of said rearward element of each of said corrugations cooperatively define a combined open area which constitutes about one-third of the total surface area of said rearward element.

9. The assembly of claim 7 wherein said shield further includes an imperforate frame extending about the periphery of both said corrugated member and said acoustical material and enclosing the sides and ends therof.

10. The assembly of claim 7 wherein said shield is fabricated from metal.

11. The assembly of claim 7 wherein said forward element and said rearward element of each of said corrugations are generally planar.

12. The assembly of claim 7 wherein said included obtuse angle is about 95°.

13. The assembly of claim 7 further including an imperforate backing member secured to said frame of said shield with said absorbent material disposed therebetween.

14. The assembly of claim 13 wherein said backing member is fabricated from metal.

15. The assembly of claim 7 further including a moisture-proof material covering said acoustical material.

16. The assembly of claim 15 wherein said moisture-proof material is plastic.

* * * * *